US009686844B2

(12) United States Patent
Coleman et al.

(10) Patent No.: US 9,686,844 B2
(45) Date of Patent: Jun. 20, 2017

(54) INTENSE X-RAY AND EUV LIGHT SOURCE

(71) Applicant: Los Alamos National Security, LLC, Los Alamos, NM (US)

(72) Inventors: Joshua Coleman, Santa Fe, NM (US); Carl Ekdahl, Santa Fe, NM (US); John Oertel, Los Alamos, NM (US)

( * ) Notice: Subject to any disclaimer, the term of this patent is extended or adjusted under 35 U.S.C. 154(b) by 0 days.

(21) Appl. No.: 15/088,366

(22) Filed: Apr. 1, 2016

(65) Prior Publication Data

US 2016/0302294 A1 Oct. 13, 2016

Related U.S. Application Data

(60) Provisional application No. 62/146,617, filed on Apr. 13, 2015.

(51) Int. Cl.
*H05G 2/00* (2006.01)

(52) U.S. Cl.
CPC ..... *H05G 2/00* (2013.01)

(58) Field of Classification Search
USPC ..... 250/370.09, 504 R, 526
See application file for complete search history.

(56) References Cited

U.S. PATENT DOCUMENTS 4,752,728 A * 6/1988 Nakamura ..... G01B 7/023 324/318

FOREIGN PATENT DOCUMENTS

WO WO 2016/131569 A1 * 8/2016 ..... H05H 7/14

* cited by examiner

*Primary Examiner* — Bernard Souw
(74) *Attorney, Agent, or Firm* — LeonardPatel PC

(57) ABSTRACT

An intense X-ray or EUV light source may be driven by the Smith-Purcell effect. The intense light source may utilize intense electron beams and Bragg crystals. This may allow the intense light source to range from the extreme UV range up to the hard X-ray range.

20 Claims, 10 Drawing Sheets

200

205

300

305

310

400

405

600

INTENSE X-RAY AND EUV LIGHT SOURCE

CROSS REFERENCE TO RELATED APPLICATION

This application claims the benefit of U.S. Provisional Application Ser. No. 62/146,617, filed on Apr. 13, 2015. The subject matter of this earlier filed provisional patent application is hereby incorporated by reference in its entirety.

STATEMENT OF FEDERAL RIGHTS

The United States government has rights in this invention pursuant to Contract No. DE-AC52-06NA25396 between the United States Department of Energy and Los Alamos National Security, LLC for the operation of Los Alamos National Laboratory.

FIELD

The present invention generally relates to an intense light source, and more particularly, to an intense source of electromagnetic (EM) radiation ranging from the extreme ultraviolet (EUV) range up to the hard X-ray range using the Smith-Purcell effect.

BACKGROUND

EM radiation generated by fields of an electron beam passing by a periodic structure was first observed by Smith and Purcell in 1953. At that time, they grazed an electron beam over a metallic diffraction grating with a 1.67 μm spacing and observed visible light in the 450-550 nm range. Since this demonstration, a number of different techniques have used the Smith-Purcell effect to produce infrared (IR) sources, microwave sources, and particle beam diagnostics.

However, a more intense source of EM radiation ranging from the EUV range up to the hard X-ray range may be beneficial.

SUMMARY

Certain embodiments of the present invention may provide solutions to the problems and needs in the art that have not yet been fully identified, appreciated, or solved by conventional light sources. For example, some embodiments of the present invention pertain to an electron beam propagating through a vacuum section of a beam pipe. The electron beam may graze over a periodic structure including Bragg crystals, and an EUV source or an X-ray source may be produced based on the energy level of the electron beam and the lattice spacing of the crystalline structure.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Figure 1:
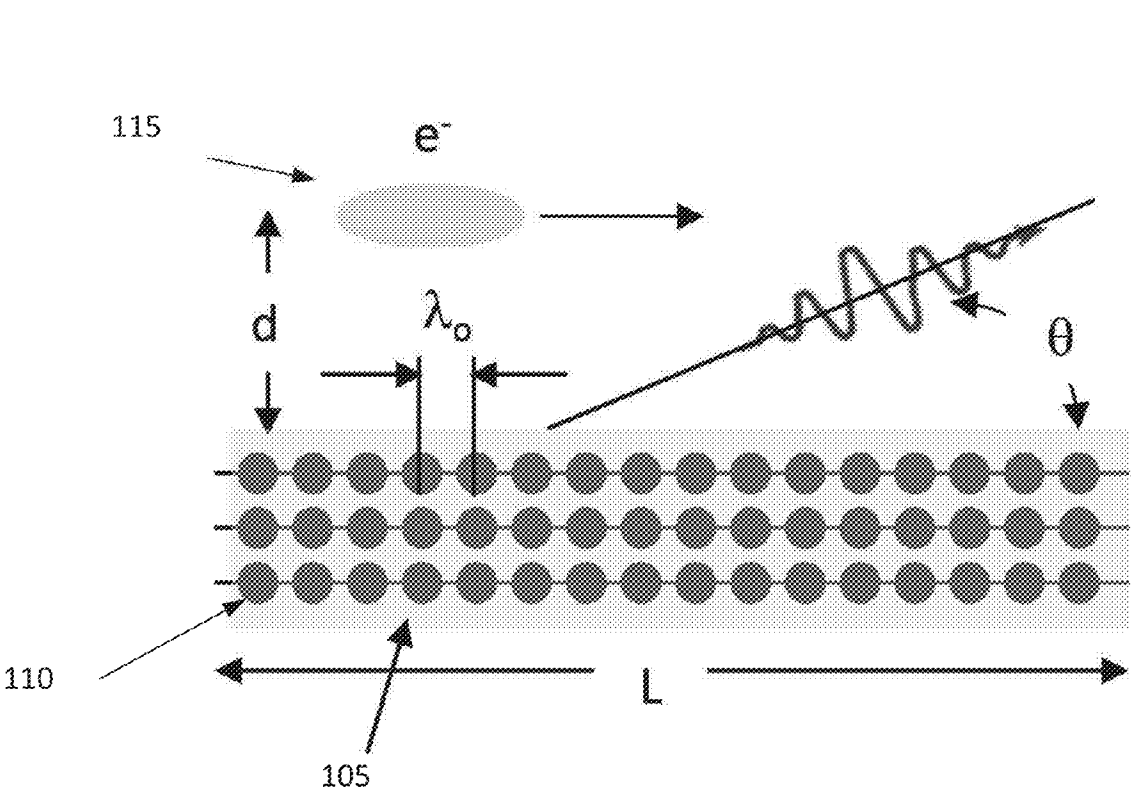
FIG. 1 illustrates a layout of a Smith-Purcell X-ray and EUV light source, according to an embodiment of the present invention.

FIG. 1 illustrates a layout 100 of a Smith-Purcell X-ray and EUV light source, according to an embodiment of the present invention. In some embodiments, a Smith-Purcell X-ray and EUV light source may be driven by an electron beam 115 utilizing a Bragg crystal 110 as a periodic structure. Also, in some embodiments, L is the length of a periodic structure, such as crystalline lattice in some embodiments, 105, d is the spacing between electron beam 115 and periodic structure 105, $\lambda_o$ is the lattice spacing of Bragg crystal 110, and θ is the scattering angle of the radiation.

In some further embodiments, self-fields of electron beam 115 interact with the periodic structure generating an EM wave. Electron beam 115 may graze over periodic structure 105, which may have an atomic lattice spacing. Electron beam 115 may have a specific charge based on its current and pulse length (which is flexible). This charge will impose an image charge on the periodic structure. In addition, self-fields, such as axial and radial electric fields and the azimuthal magnetic field, may interact with periodic structure 105. Together these self-fields may radiate an EM wave off the surface of periodic structure 105. The characteristics of this EM is formulated below.

In some embodiments, Bragg crystal 110 may have a lattice spacing ranging from 1 Å-10 nm. In some embodiments, a low energy electron beam 115 (γ=1.1-1.2) and a Bragg crystal 110 with a lattice spacing near 10 nm may provide an EUV source that can produce photon wavelengths from 24 nm down to 10 nm. γ is the Lorentz factor or ratio of total kinetic energy of a relativistic particle to the rest energy of that particle. Relativistic electrons with γ>2 may produce photons with Eγ>100 eV (λ<10 nm) with a 1 nm lattice spaced crystal.

It should be appreciated that Smith-Purcell radiation is EM radiation generated by a particle beam, such as electron beam 115, when passing near a periodic structure, such as a crystalline lattice, 105. Electric fields of electron beam 115 may interact with the periodicity of periodic structure 105 to scatter the EM radiation off at an angle θ relative to the propagation of electron beam 115. The scattered wavelength of the scattered radiation, $\lambda_s$, is given by:

$$\lambda_s = \lambda_o\left(\frac{1}{\beta} - \cos\theta\right) \tag{1}$$

where $\lambda_o$ is the periodic spacing of the periodic structure 105 with electron beam 115 passing over, $\beta$ is the ratio of electron beam 115 velocity to the speed of light, and $\theta$ is the scattering angle of the radiation. The scattered radiation may be directly proportional to the periodicity of structure 105, such that of visible and infrared gratings used in spectrometers. 100 nm-2 μm blaze angles used in junction with electron beam 105 can generate sources of visible and infrared light.

In some embodiments, structure 105 with 10 cm-1 mm periodic spacing may be used as a high power microwave generator. In other embodiments, X-ray or Bragg crystals with two dimensional (2-D) lattice spacing of 10 nm-1 Å may be used to generate an intense source of EUV or hard X-rays. In both embodiments discussed above, $E_\gamma$ may be close to $1/\lambda_o$ of periodic structure 105. However, the generated spectrum may be dependent on several parameters as discussed below in more detail.

The angular radiated power $P(\theta)$ off the periodic structure is given by $$P(\theta) = \frac{\pi e I L R^2}{\varepsilon_o \lambda_o^2} \frac{\beta^3 \sin^2\theta}{(1-\beta\cos\theta)^3} \exp\left(\frac{-4\pi d}{\lambda_o \gamma (1-\beta\cos\theta)}\right), \quad (2)$$

where I is the electron current, L is the length of periodic structure 105, R is the reflectivity of periodic structure 105, $\theta$ is the scattering angle, d is the spacing between the electron beam 115 and periodic structure 105, $\epsilon_o$ is the permittivity of free space, and $\gamma$ is the relativistic Lorentz factor or ratio of total kinetic energy of relativistic particle to the rest energy of that particle. The periodicity of periodic structure 105 (2-D lattice spacing), the proximity and parameters of electron beam 115, and the energy and current of electron beam 115 may determine the power spectrum of the radiation generated from the source.

In certain embodiments, the radiated power is negligible until $d/\lambda_o<5$. Once this threshold is achieved, the radiation increases exponentially as electron beam 115 approaches a distance close to the wavelength of the generated radiation or the periodic spacing of periodic structure 105. Furthermore, the photon energy may increase drastically with the energy of electron beam 115 and the peak radiation becomes collimated as the relativistic factor, $\gamma$ increases. The number of photons $N_\gamma(\theta)$ is calculated by $$N_\gamma(\theta) = \frac{P(\theta)t}{E(\theta)} = \frac{P(\theta)t\lambda_s(\theta)}{hc} \quad (3)$$

where t is the pulse length of electron beam 115, h is Planck's constant, and c is the speed of light. For example, initial estimates indicate grazing a 1.7 kA, 20 MeV, 60 ns electron beam 115 within ~1 nm of a 1-cm long Ammonium dihydrogen phosphate (ADP) crystal radiates 3.9-8.7 keV X-rays at P~800 MW. This may produce photon yields $>10^{16}$ which would be forward scattered at angles <45°. In some embodiments, the ADP crystal, which has a 2-D lattice spacing of 1.06 nm, may be used.

Figure 2A:
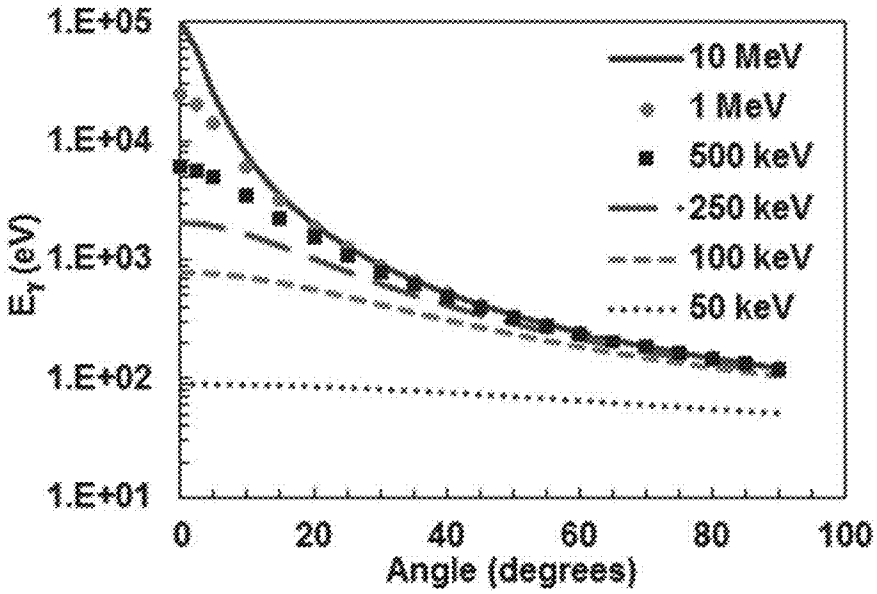
FIGS. 2A and 2B are graphs illustrating an energy spectrum and a power spectrum for electron beams of different energies, according to an embodiment of the present invention.
Figure 2B:
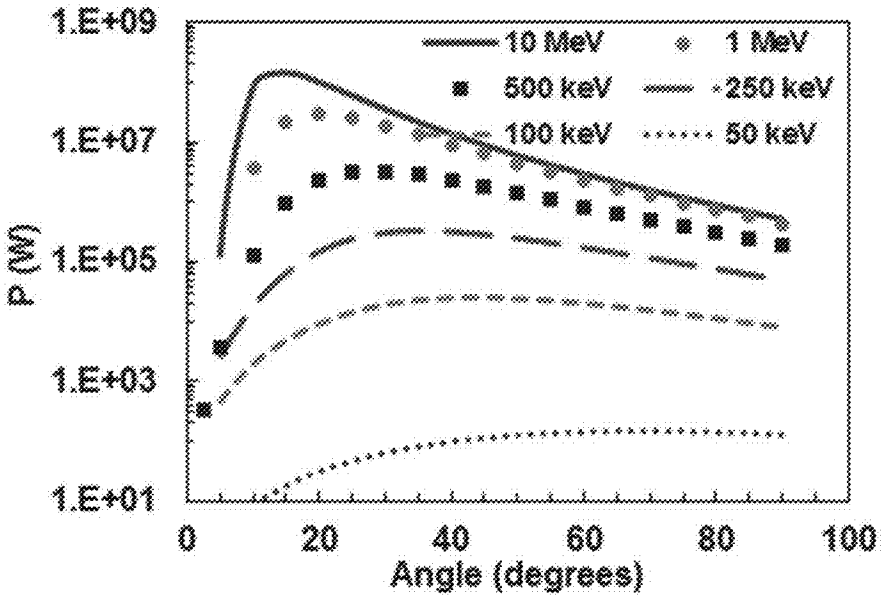

FIGS. 2A and 2B are graphs illustrating an energy spectrum 200 and a power spectrum 205 for electron beams of different energies, according to an embodiment of the present invention. An analytical study was performed to quantify the parameter space of an intense X-ray and EUV light source driven by the Smith-Purcell effect. The first step was to determine the energy spectrum that could be generated using Eq. (1). For this case, a generic 1 cm long crystal with a lattice spacing of 10 nm and an electron-to-crystal interaction spacing of 1 nm, $d/\lambda_o=0.1$ was assumed. During this study, a function of electron energies ranging between 50 keV-10 MeV were examined. See, for example, FIGS. 2A and 2B. Graph 200 in FIG. 2A shows that the energy spectrum for the 50 keV beam is a fairly narrow band, and 50-80 eV photons are scattered in all directions. However, as the beam becomes relativistic, the distribution becomes peaked and wide band. For example, with 10 MeV, 100 keV X-rays were produced and forward scattered and EUV photons with energies of 100 eV were generated perpendicular to the beam. The power in this example is estimated assuming a reflectivity of 1 %.

Graph 205 in FIG. 2B shows that radiated photon power levels peak just above 100 W at $\theta>40°$ for a 50 keV, 10 A electron beam. Again, as the electron beam becomes relativistic, the distribution becomes peaked at shallow angles. The 10 MeV, 1 kA case in some embodiments ranges from 500 kW photon power levels normal to the beam to just over 100 MW at ~15°.

It should be appreciated that the theory discussed above with respect to Eq. (2) appears to break down at low periodic spacing $\lambda_o$ and high values of $\gamma$. For example, consider a 50 keV, 10 A electron beam with peak electron power at 500 kW. Assuming, for example, a 1 cm long crystal with a lattice spacing of 10 nm and a reflectivity of 1 percent, the first coefficient in Eq. (2) equates to 5.7 kW. After examining this coefficient more closely, $P\sim\lambda_o^{-2}$, such that this coefficient increases to 57 MW for a 1 Å spacing and is independent of energy.

Figure 3A:
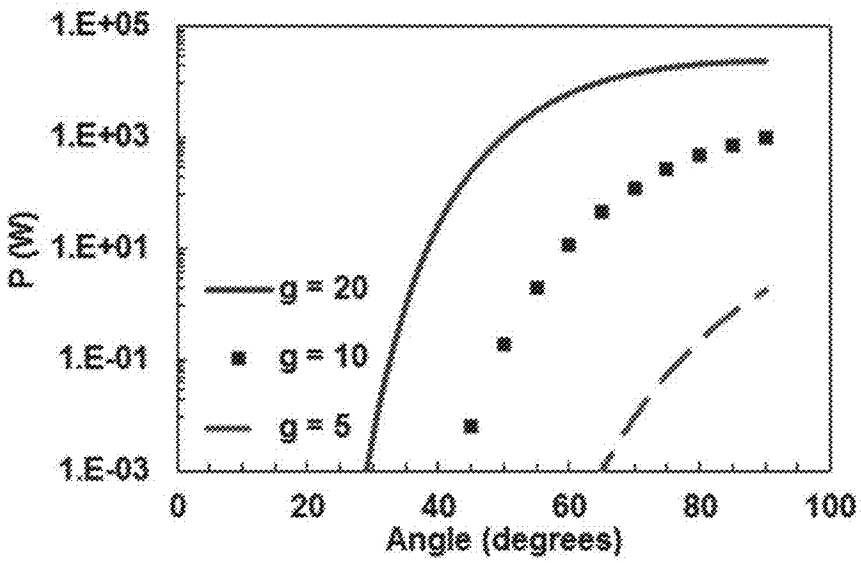
FIGS. 3A-3C are graphs illustrating a photon power spectrum for electron beams, according to an embodiment of the present invention.
Figure 3B:
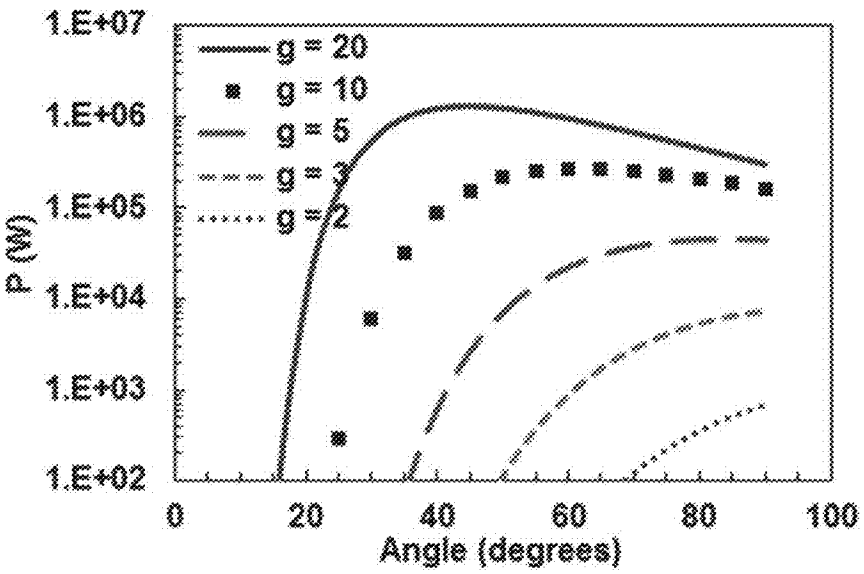
Figure 3C:
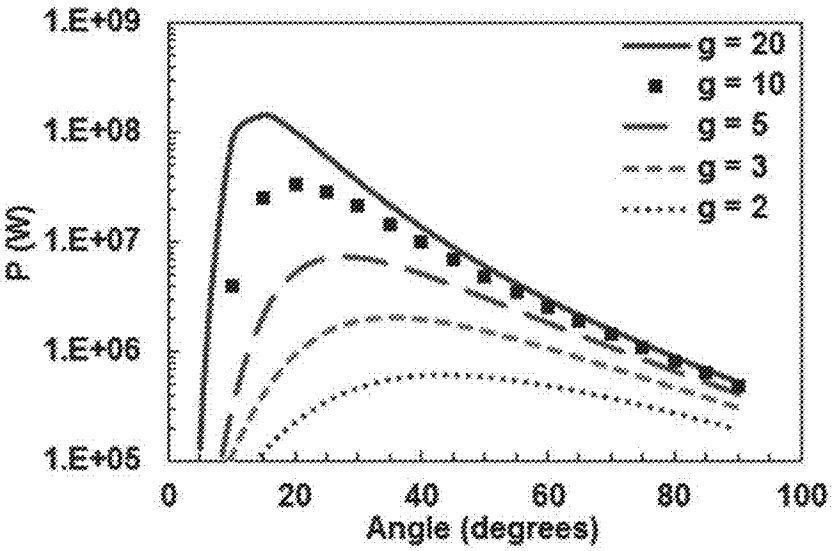

It should also be appreciated that the radiated photon power spectrum as a function of beam energy and interaction spacing $d/\lambda_o$ was examined and is shown in FIGS. 3A-3C. Graph 300 in FIG. 3A shows that at a large interaction spacing $d/\lambda_o=5$, the bulk of the power is radiated perpendicular to the beam and does not reach 1 W until $\gamma\geq5$.

As the relativistic factor $\gamma$ increases by factors of 2, the power increases several orders of magnitude and is more widespread in space. As $d/\lambda_o$ is reduced to 1, the radiation spreads out more in space and the lower energy beams begin to radiate at more than 1 kW perpendicular to the beam. This is shown in graph 305 of FIG. 3B. The most relativistic case $\gamma=20$ begins to develop a peaked distribution at a forward angle less than 40°. Graph 310 of FIG. 3C shows the most extreme case, where $d/\lambda_o=0.1$. In this case, all ranges of beam energy have a peaking distribution and tend to be more forward scattered as relativistic electrons $\gamma>3$. The photon power levels range from 100 kW-100 MW for beam powers of 5 MW-100 MW. At this point, it becomes evident that the statement made about Eq. (2) breaking down is presenting itself.

After examining FIGS. 3A-3C, the dependence of photon power on beam energy and interaction spacing is demonstrated. For example, passing a 2 MeV, 10 A electron beam within 5 nm of a 1 cm long crystalline lattice with a lattice spacing of 1 nm should produce ~2 W at 90°. In another example, a 10 MeV electron beam and 20 nm interaction spacing may produce ~2 W at 90°. As the interaction spacing is reduced by a factor of 5, the photon power increases by orders of magnitude.

Figure 4A:
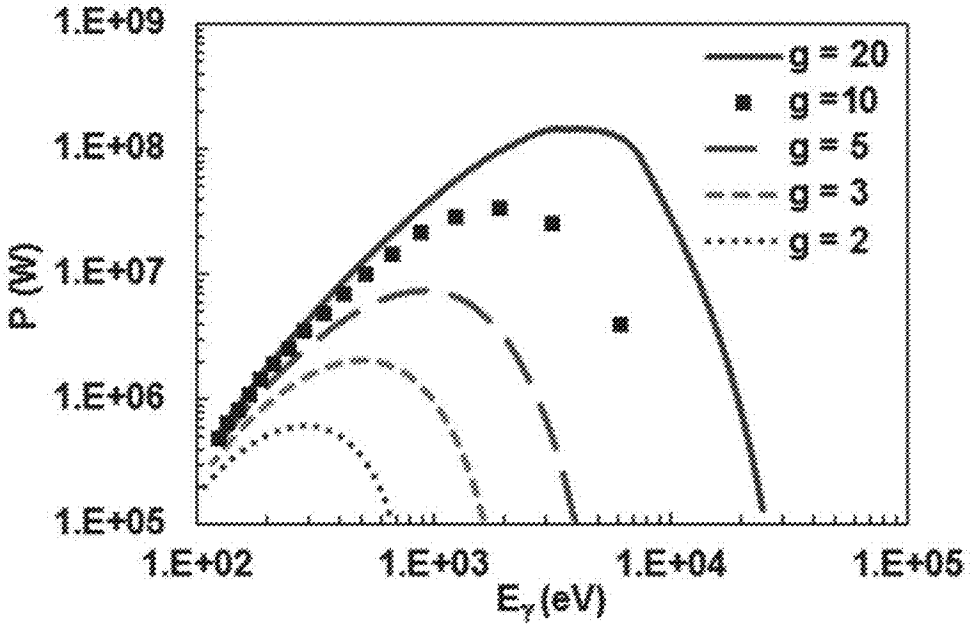
FIGS. 4A and 4B are graphs illustrating power and a number of photons, according to an embodiment of the present invention.

The close interaction spacing $d/\lambda_o=0.1$ for the 1 cm long crystalline lattice with a lattice spacing of 1 nm is now examined more thoroughly. As shown in graph 400 of FIG. 4A, the photon power spectrum as a function of photon energy is shown. The value of the different electron beam energies is also shown. The 500 keV (y=2) beam produces a spectrum exclusively in the soft X-ray range (100-800 eV, 1-10 nm) with power levels above 100 kW or greater than $10^{13}$ photons, assuming a 100 ns beam length. As the relativistic factor γ increases, the peak of the photon spectrum moves to higher energies and shallower angles. It should be noted, however, that the photon spectrum for all relativistic γ values, span from the soft X-ray region at normal angles well into the hard X-ray range.

Figure 4B:
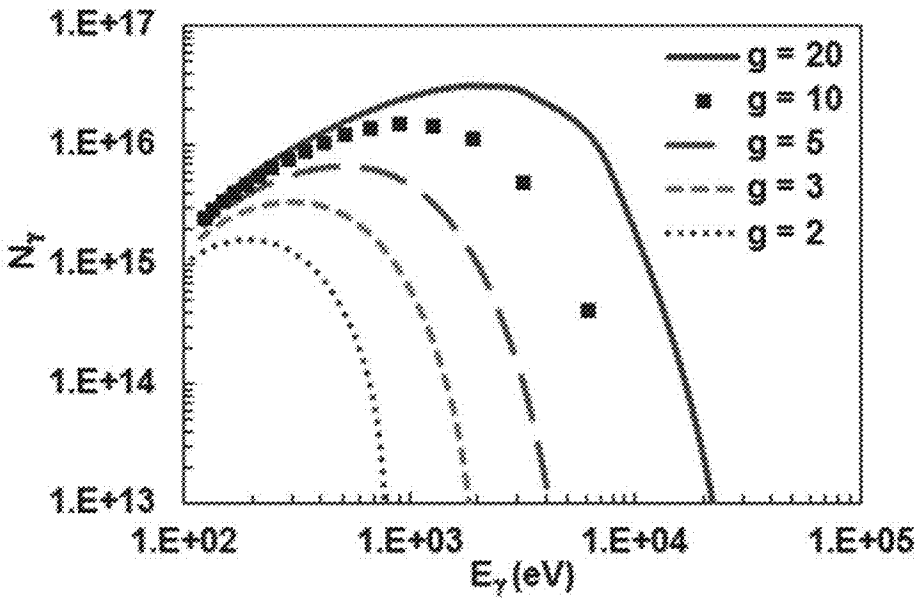

Turning to FIG. 4B, graph 405 shows the number of photons that are yielded. From graph 405, it is evident that the photon count falls off steeply at the right edge. As the relativistic factor γ is increased, the photon count increases gradually from the soft X-ray range to the peaks in hard X-ray range. Comparing the power and photon count spectrum, the peak spectrum at relativistic electrons γ=2 ranges from 190-280 eV, the peak for γ=3 it spans from 300-500 eV, for γ=5 it ranges from 500-800 eV, for γ=10 it ranges from 900-1900 eV, and for γ=20 it peaks from 2-3.5 keV.

Figure 5:
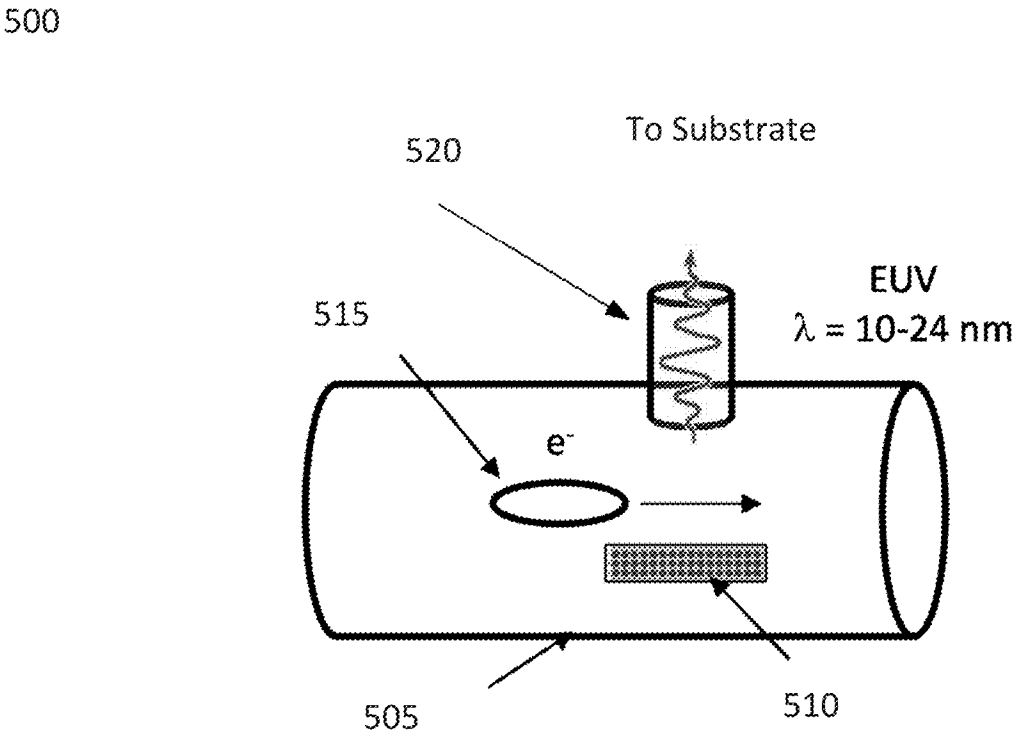
FIG. 5 illustrates a EUV light source structure, according to an embodiment of the present invention.

FIG. 5 illustrates an EUV light source structure 500, according to an embodiment of the present invention. In some embodiments, a beam pipe 505 includes a crystalline lattice 510. An electron beam 515 propagates in a vacuum through beam pipe 505. As electron beam 515 grazes over periodic structure 510, EUV radiation may be produced and transmitted to a substrate via pipe 520 at a 90° angle.

In certain embodiments, electron beam 515 may be a low energy electron beam (50-100 keV, γ=1.1-1.2) and periodic structure 510 may include Bragg crystals with a lattice spacing near 10 nm. Photon wavelengths from 24 nm down to 10 nm may be generated at power levels near 100 W at any angle along the Bragg crystals if the interaction spacing $d/\lambda_o<0.1$. See, for example, graph 200 of FIG. 2A.

In other words, FIG. 5 illustrates a well-controlled electron beam transported through a vacuum section with an insertable Bragg crystal. The electron beam length and generated photon pulse length may be determined by the lithographic application in some embodiments. Shielding, collimation, or focusing optics may also be used in some embodiments to optimize the radiation for lithography.

The X-ray source may include relativistic electrons γ>2, which produce photons with $E_\gamma>100$ eV with a 1 nm lattice spaced crystal. See, for example, FIG. 6, which illustrates an X-ray source structure 600, according to an embodiment of the present invention. In some embodiments, an electron beam 615 having energy greater than 0.5 MeV is transported through a vacuum section of beam pipe 605 with a periodic structure 610. The required electron beam length and generated photon pulse length may be determined by the application.

Photon wavelengths $1<\lambda(\text{nm})<10$ may be generated at power levels near 100 kW at θ>20° along the Bragg crystal when the interaction spacing $d/\lambda_o<0.1$. See, for example, FIGS. 2A, 3C, and 4. Photon counts in this embodiment may exceed $10^{15}$ for electron beams with γ>10, I>1 kA, and bunch lengths of 100 ns. The photon wavelength produced may be transmitted to a test section via pipe 620.

Figure 6:
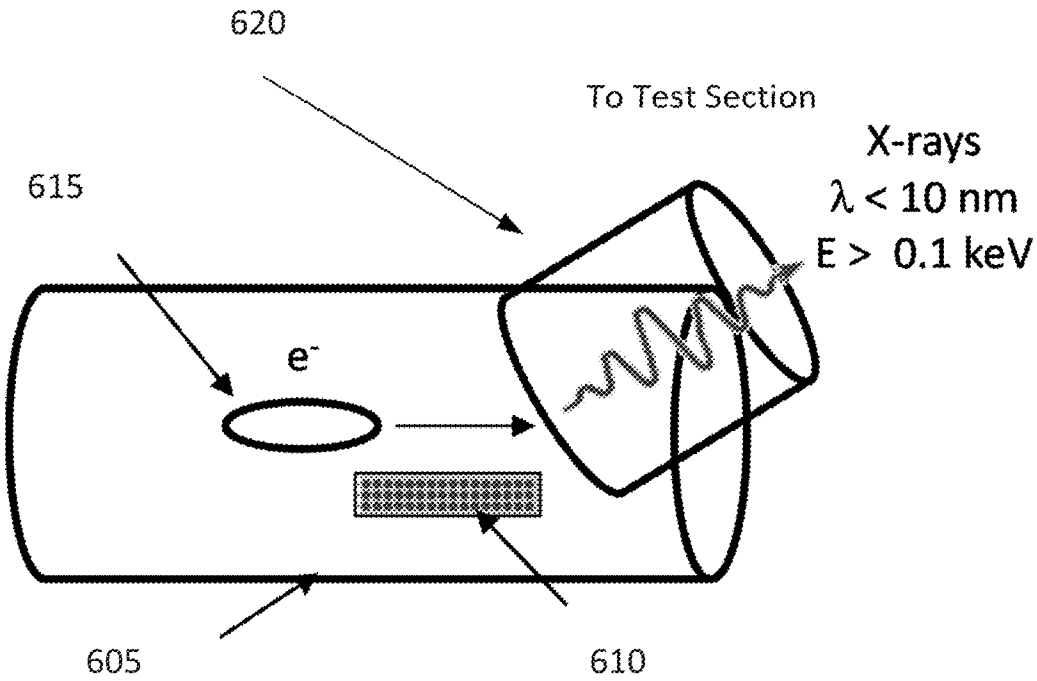
FIG. 6 illustrates an X-ray source structure, according to an embodiment of the present invention.

It should be appreciated that the EUV source of FIG. 5 and X-ray source of FIG. 6 may be generated with a single accelerator. The EUV source in some embodiments may be developed at the exit of a 50 keV injector of an electron accelerator. The X-ray source in some embodiments may be fabricated at any point along a linear accelerator where the electron energy exceeds 500 keV and the photon energy is in the desired range and angle of the costumer.

Some embodiments pertain to intense X-ray and EUV light sources driven by the Smith-Purcell effect utilizing intense electron beams and Bragg crystals. In some embodiments, non-relativistic beams with relativistic electrons γ of 1.1-1.2 grazing a crystal with 10 nm lattice spacing may produce EUV photons from 24 nm down to 10 nm. Reducing the lattice spacing of the crystal to 1 nm and increasing the beam energy to relativistic energies may yield photons from the soft X-ray range to the hard X-ray range for relativistic electrons γ>2 in some embodiments. The photon spectrum is highly dependent on the interaction spacing $d/\lambda_o$, and for the wavelengths of interest, the beam may need to graze the crystal with d<1 nm.

In an embodiment, an apparatus may include an electron beam that propagates through a vacuum section of a beam pipe. The electron beam may graze over a periodic structure comprising a Bragg crystal or a crystalline lattice, producing an EUV source or an X-ray source based on an energy level of the electron beam and a lattice spacing of the periodic structure.

In some embodiment, the lattice spacing includes atomic spacing within the Bragg crystal or the crystalline lattice. In some further embodiments, the graze of the electron beam over the periodic structure is defined by a distance between the electron beam and the periodic structure. In yet some further embodiments, a yield of a photon energy and a spectrum of the photon energy may be dependent on the energy level of the electron beam and an interaction spacing. In certain embodiments, the interaction spacing may be defined by $d/\lambda_o$, where d is distance between the electron beam and the periodic structure and $\lambda_o$ is the lattice spacing of the periodic structure with the electron beam passing over the periodic structure.

In some additional embodiments, a yield of the photon power may be dependent upon a current of the electron beam and a pulse length of the electron beam. In certain embodiments, a photon flux may be dependent upon a density distribution of the electron beam.

In some embodiments, the electron beam may include electric and magnetic fields that interact with a periodicity of the periodic structure to scatter electromagnetic radiation at an angle relative to a propagation of the electron beam.

In some additional embodiments, the scattered electromagnetic radiation is defined by $$\lambda_s = \lambda_o\left(\frac{1}{\beta} - \cos\theta\right)$$

where $\lambda_o$ is the lattice spacing of the periodic structure with the electron beam passing over the periodic structure, β is a ratio of a velocity of the electron beam relative to speed of light, and θ is a scattering angle of the radiation.

In some further embodiments, the scattered electromagnetic radiation may be proportional to a periodicity of the periodic structure.

In an alternative embodiment, an apparatus may include a beam pipe, which may include one or more vacuum sections. Each of the one or more vacuum sections may include a periodic structure having Bragg Crystals or a crystalline lattice. The apparatus may also include an electron beam that grazes over the periodic structure in each of the one or more vacuum sections, producing an EUV source or an X-ray source based on an energy level of the electron beam and a lattice spacing of the periodic structure.

In some embodiments, the lattice spacing for the periodic structure in each of the one or more vacuum sections may include a varying atomic spacing. In some additional embodiments, the lattice spacing may be uniform in each of the one or more vacuum sections. In some further embodiments, the lattice spacing may differ in each of the one or more vacuum sections. In yet some additional embodiments, the energy level of the electron beam may incrementally increase in between the one or more vacuum sections.

In certain embodiments, the generated EUV source is transmitted through the beam pipe and to a substrate at an angle. In some further embodiments, the angle may be dependent upon the energy level of the electron beam, which may include gamma less than 2 and the lattice spacing of the periodic structure in each of the one or more vacuum sections. In some additional embodiments, the generated X-ray source may be transmitted through the beam pipe and to a test section at an angle. In yet some additional embodiments, the angle may be dependent upon the energy level of the electron beam, which may include gamma greater than 2 and the lattice spacing of the periodic structure in each of the one or more vacuum sections.

In another embodiment, an apparatus may include a plurality of vacuum sections. Each of the plurality of vacuum sections may include a periodic structure. The apparatus may also include an electron beam traversing over the periodic structure in each of the plurality of vacuum structures to produce an EUV source when an energy level of the electron beam includes gamma less than 2 or produce an X-ray source when the energy level of the electron beam includes gamma greater than 2.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics that may be combined in any suitable manner in one or more embodiments.

It should be noted that reference throughout this specification to features, advantages, or similar language does not imply that all of the features and advantages may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

an electron beam propagating through a vacuum section of a beam pipe, wherein the electron beam grazes over a periodic structure comprising a Bragg crystal or a crystalline lattice, producing an extreme ultraviolet (EUV) source or an X-ray source based on an energy level of the electron beam and a lattice spacing of the periodic structure.

2. The apparatus of claim 1, wherein the lattice spacing comprises of atomic spacing within the Bragg crystal or the crystalline lattice.

3. The apparatus of claim 1, wherein the graze of the electron beam over the periodic structure is defined by a distance between the electron beam and the periodic structure.

4. The apparatus of claim 1, wherein a yield of a photon energy and a spectrum of the photon energy are dependent on the energy level of the electron beam and an interaction spacing.

5. The apparatus of claim 4, wherein the interaction spacing is defined by $d/\lambda_o$, where d is distance between the electron beam and the periodic structure and $\lambda_o$ is the lattice spacing of the periodic structure with the electron beam passing over the periodic structure.

6. The apparatus of claim 1, wherein a yield of the photon power is dependent upon a current of the electron beam and a pulse length of the electron beam.

7. The apparatus of claim 1, wherein a photon flux is dependent upon a density distribution of the electron beam.

8. The apparatus of claim 1, wherein the electron beam comprises electric and magnetic fields that interact with a periodicity of the periodic structure to scatter electromagnetic radiation at an angle relative to a propagation of the electron beam.

9. The apparatus of claim 8, wherein the scattered electromagnetic radiation is defined by $$\lambda_s = \lambda_o\left(\frac{1}{\beta} - \cos\theta\right)$$

where $\lambda_o$ is the lattice spacing of the periodic structure with the electron beam passing over the periodic structure, $\beta$ is a ratio of a velocity of the electron beam relative to speed of light, and $\theta$ is a scattering angle of the radiation.

10. The apparatus of claim 8, wherein the scattered electromagnetic radiation is proportional to a periodicity of the periodic structure.

11. An apparatus, comprising:

a beam pipe comprising one or more vacuum sections, each of the one or more vacuum sections comprises a periodic structure having Bragg Crystals or a crystalline lattice; and an electron beam grazes over the periodic structure in each of the one or more vacuum sections, producing an extreme ultraviolet (EUV) source or an X-ray source based on an energy level of the electron beam and a lattice spacing of the periodic structure.

12. The apparatus of claim 11, wherein the lattice spacing for the periodic structure in each of the one or more vacuum sections comprises a varying atomic spacing.

13. The apparatus of claim 11, wherein the lattice spacing is uniform in each of the one or more vacuum sections.

14. The apparatus of claim 11, wherein the lattice spacing differs in each of the one or more vacuum sections.

15. The apparatus of claim 11, wherein the energy level of the electron beam incrementally increases in between the one or more vacuum sections.

16. The apparatus of claim 11, wherein the generated EUV source is transmitted through the beam pipe and to a substrate at an angle.

17. The apparatus of claim 16, wherein the angle is dependent upon the energy level of the electron beam comprising gamma less than 2 and the lattice spacing of the periodic structure in each of the one or more vacuum sections.

18. The apparatus of claim 11, wherein the generated X-ray source is transmitted through the beam pipe and to a test section at an angle.

19. The apparatus of claim 16, wherein the angle is dependent upon the energy level of the electron beam comprising gamma greater than 2 and the lattice spacing of the periodic structure in each of the one or more vacuum sections.

20. An apparatus, comprising:

a plurality of vacuum sections, each of the plurality of vacuum sections comprises a periodic structure; and an electron beam traversing over the periodic structure in each of the plurality of vacuum structures to produce an extreme ultraviolet (EUV) source when an energy level of the electron beam comprises gamma less than 2 or produce an X-ray source when the energy level of the electron beam comprises gamma greater than 2.

* * * * *